US010562159B2

(12) United States Patent
Bassett et al.

(10) Patent No.: US 10,562,159 B2
(45) Date of Patent: Feb. 18, 2020

(54) BOLT TIGHTENING SYSTEM

(71) Applicant: General Electric Company, Schenectady, NY (US)

(72) Inventors: Brian Kenneth Bassett, Greenville, SC (US); Robert Scott Phillips, Greenville, SC (US); Peter Koppenhoefer, East Stroudsburg, PA (US); Michael F. Dolan, Jr., Manasquan, NJ (US)

(73) Assignee: General Electric Company, Schenectady, NY (US)

( * ) Notice: Subject to any disclaimer, the term of this patent is extended or adjusted under 35 U.S.C. 154(b) by 174 days.

(21) Appl. No.: 15/883,484

(22) Filed: Jan. 30, 2018

(65) Prior Publication Data

US 2019/0232468 A1 Aug. 1, 2019

(51) Int. Cl.
*B25B 21/00* (2006.01)
*B25B 23/00* (2006.01)

(52) U.S. Cl.
CPC ..... *B25B 21/007* (2013.01); *B25B 23/0035* (2013.01); *B25B 23/0085* (2013.01)

(58) Field of Classification Search
CPC . B25B 23/0085; B25B 23/0035; B25B 23/04; B25B 23/10; B25B 21/007; B25B 21/002; F16B 31/021; F16B 35/045
See application file for complete search history.

(56) References Cited

U.S. PATENT DOCUMENTS 1,257,275 A 2/1918 Sartain
1,343,667 A * 6/1920 Evensen ..... B25B 21/001 81/56
1,541,007 A 6/1925 Thiemer
2,089,168 A 8/1937 Brown
2,808,749 A 10/1957 Lampke
3,331,268 A * 7/1967 Jones ..... B25B 21/002 81/55
3,604,292 A 9/1971 Sada
4,403,529 A * 9/1983 Ikeda ..... B25B 23/1415 81/56
4,472,985 A * 9/1984 Orikasa ..... B25B 21/002 81/56
4,473,317 A 9/1984 Bolang
4,550,633 A * 11/1985 Fujita ..... B25B 21/001 81/56
4,637,764 A * 1/1987 Imai ..... B25B 21/001 411/386
5,108,238 A * 4/1992 Ewing ..... F16B 31/021 411/405
5,161,437 A 11/1992 Yasutomi et al.
5,238,461 A 8/1993 Gotman
5,354,246 A 10/1994 Gotman
5,419,221 A 5/1995 Cole
5,784,934 A 7/1998 Izumisawa
6,237,450 B1 * 5/2001 Cosenza ..... B25B 15/005 81/436

(Continued)

*Primary Examiner* — David B. Thomas
(74) *Attorney, Agent, or Firm* — Eversheds Sutherland (US) LLP

(57) ABSTRACT

The present application thus provides a bolt tightening system. The bolt tightening system may include a bolt, a nut, and a bolt tightening tool. The bolt tightening tool may include an adapter and a chamber. One of the adapter and the chamber applies a torque to the bolt and one holds the nut.

15 Claims, 5 Drawing Sheets

(56) References Cited

U.S. PATENT DOCUMENTS

| | | | | |
|---|---|---|---|---|
| 8,590,429 | B2 * | 11/2013 | Goss | B25B 13/065 81/55 |
| 8,978,520 | B2 * | 3/2015 | Yoshimachi | B25B 23/0085 81/57.36 |
| 8,978,523 | B2 * | 3/2015 | Stanfield | B25B 23/0085 81/124.2 |
| 2005/0034569 | A1 * | 2/2005 | Junkers | B25B 13/488 81/121.1 |
| 2008/0226411 | A1 * | 9/2008 | McKinlay | B60B 3/145 411/2 |

* cited by examiner

BOLT TIGHTENING SYSTEM

TECHNICAL FIELD

The present application and the resultant patent relate generally to gas turbine engines and more particularly relate to a one handed bolt tightening system used to apply, tighten, and remove bolts on a gas turbine engine and elsewhere in a fast and efficient manner.

BACKGROUND OF THE INVENTION

Certain components in a gas turbine engine and other types of turbomachinery and the like are difficult to assemble and/or repair in the field. For example, a combustor can may be in communication with one or more flows of fuel and flows of air. The fuel lines and the air lines may be connected to the combustion can via conventional flange joints such as an ANSI (American National Standards Institute) flange and the like. The flange generally has two cylindrical members connected by a number of bolts with a gasket in-between. The cylindrical members and the gasket must be aligned, the bolts extended therethrough, the nuts applied, and the nuts tightened with a standard ratchet. Such a process is time and manpower intensive and often results in scrapped gaskets and leaky joints. Moreover, the bolts may be positioned in difficult to reach locations.

SUMMARY OF THE INVENTION

The present application and the resultant patent thus provide a bolt tightening system. The bolt tightening system may include a bolt, a nut, and a bolt tightening tool. The bolt tightening tool may include an adapter and a chamber. One of the adapter and the chamber applies a torque to the bolt and one holds the nut.

The present application and the resultant patent further provide a method of applying a bolt to a flange. The method may include the steps of positioning the bolt through an aperture in the flange, positioning a nut on a threaded body of the bolt, positioning a spline end of the bolt in an adapter of a bolt tightening tool, positioning the nut in a chamber of the bolt tightening tool, and applying a torque to the bolt by the bolt tightening tool while preventing the nut from rotating within the chamber.

The present application and the resultant patent further provide a bolt tightening system. The bolt tightening system may include a bolt with a threaded body and a spline end, a nut, and a bolt tightening tool. The bolt tightening tool may include an adapter sized to accommodate the spline end and a chamber sized to accommodate the nut.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
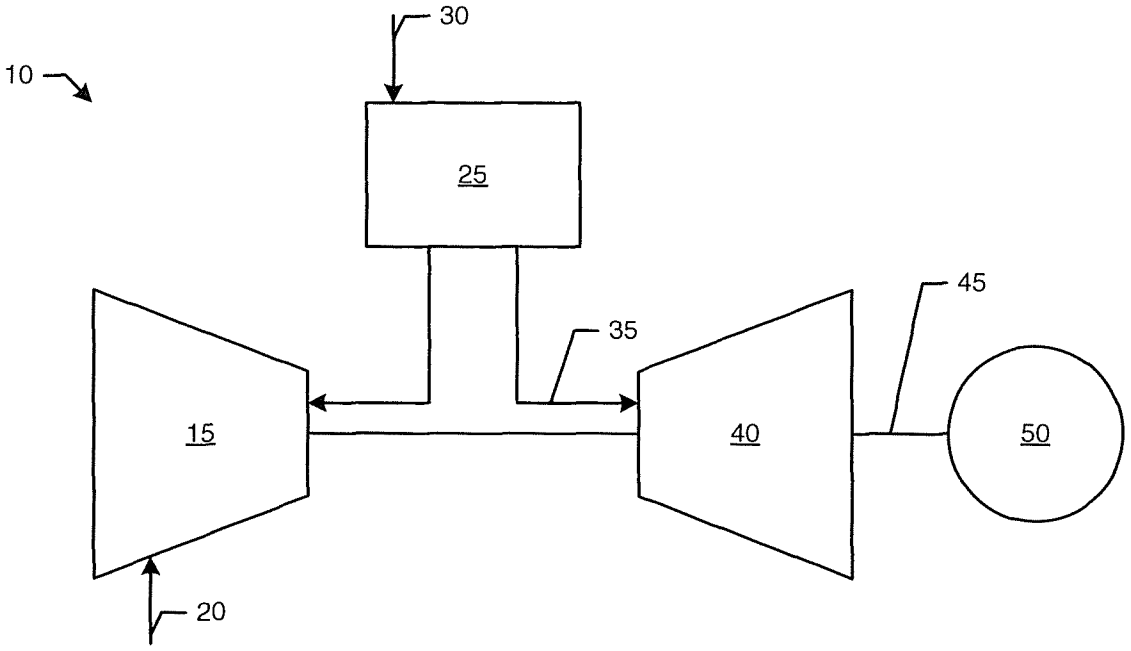
FIG. 1 is a schematic diagram of a gas turbine engine showing a compressor, a combustor, a turbine, and a load.

Referring now to the drawings, in which like numerals refer to like elements throughout the several views, FIG. 1 shows a schematic diagram of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, liquid fuels, and/or other types of fuels and blends thereof. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 3:
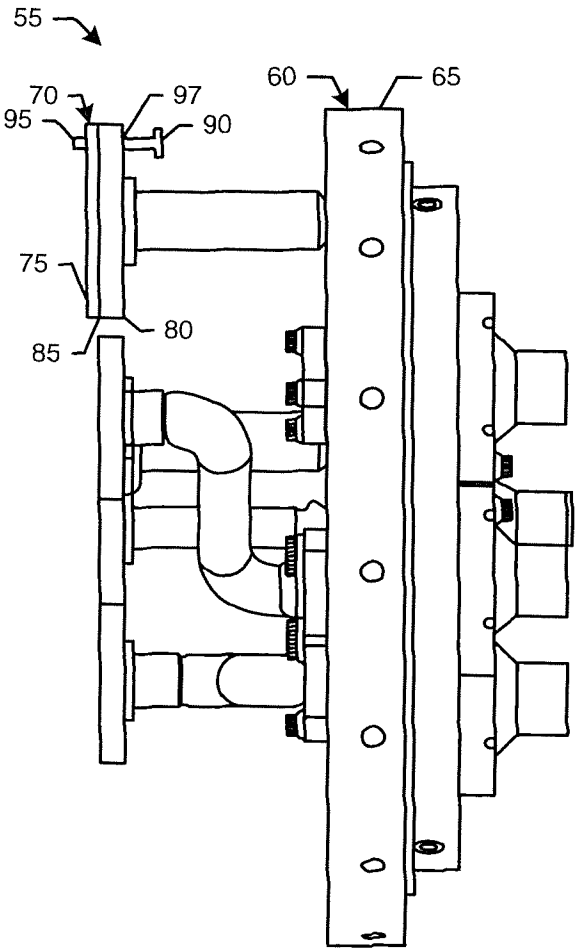
FIG. 3 is a side view of a portion of the combustor can of FIG. 2.
Figure 2:
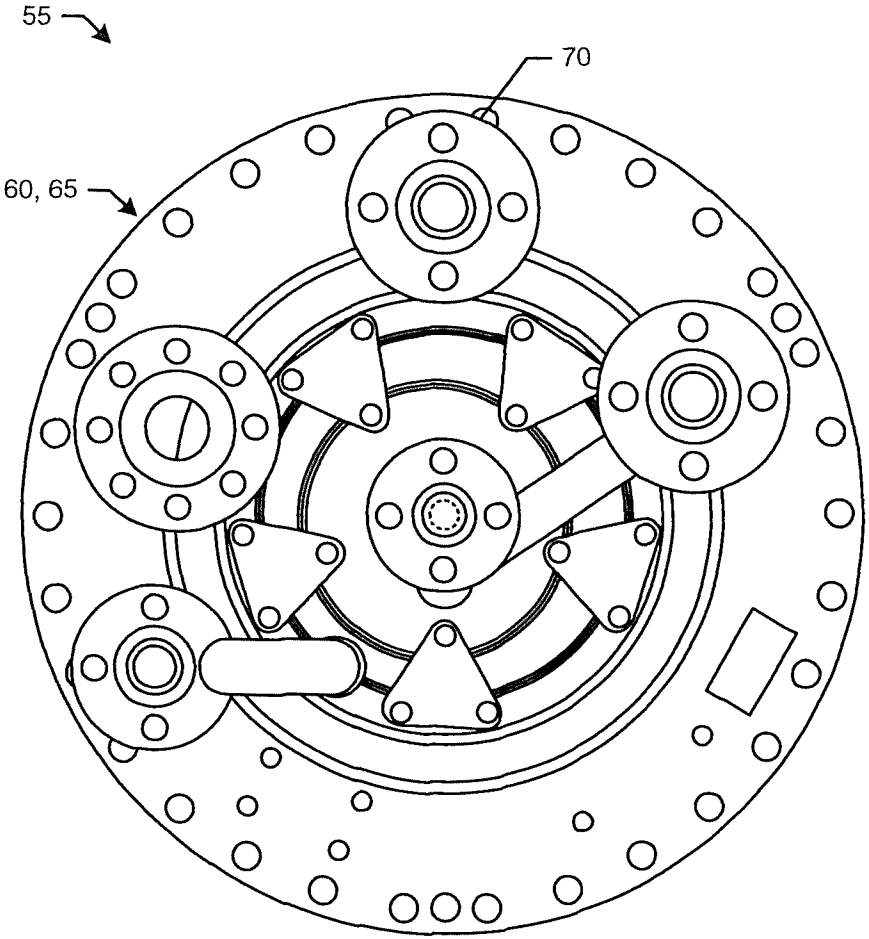
FIG. 2 is a plan view of a known combustor can.

FIGS. 2 and 3 show a turbine component 55 such as an endcover 60 of a combustor can 65 of the combustor 25. The endcover 60 may have a number fuel and air flanges 70. As described above, each flange 70 may include a first member 75, a second member 80, a gasket 85 in between, and a number of bolts 90 and nuts 95. The bolts 90 may extend through a number of bolt apertures 97 in the first member 75 and the second member 80. The flange 70 may be a conventional ANSI flange and the like. Aligning the components of the flange and torqueing the bolts 90 may be difficult and time consuming in this relatively confined space.

Figure 4:
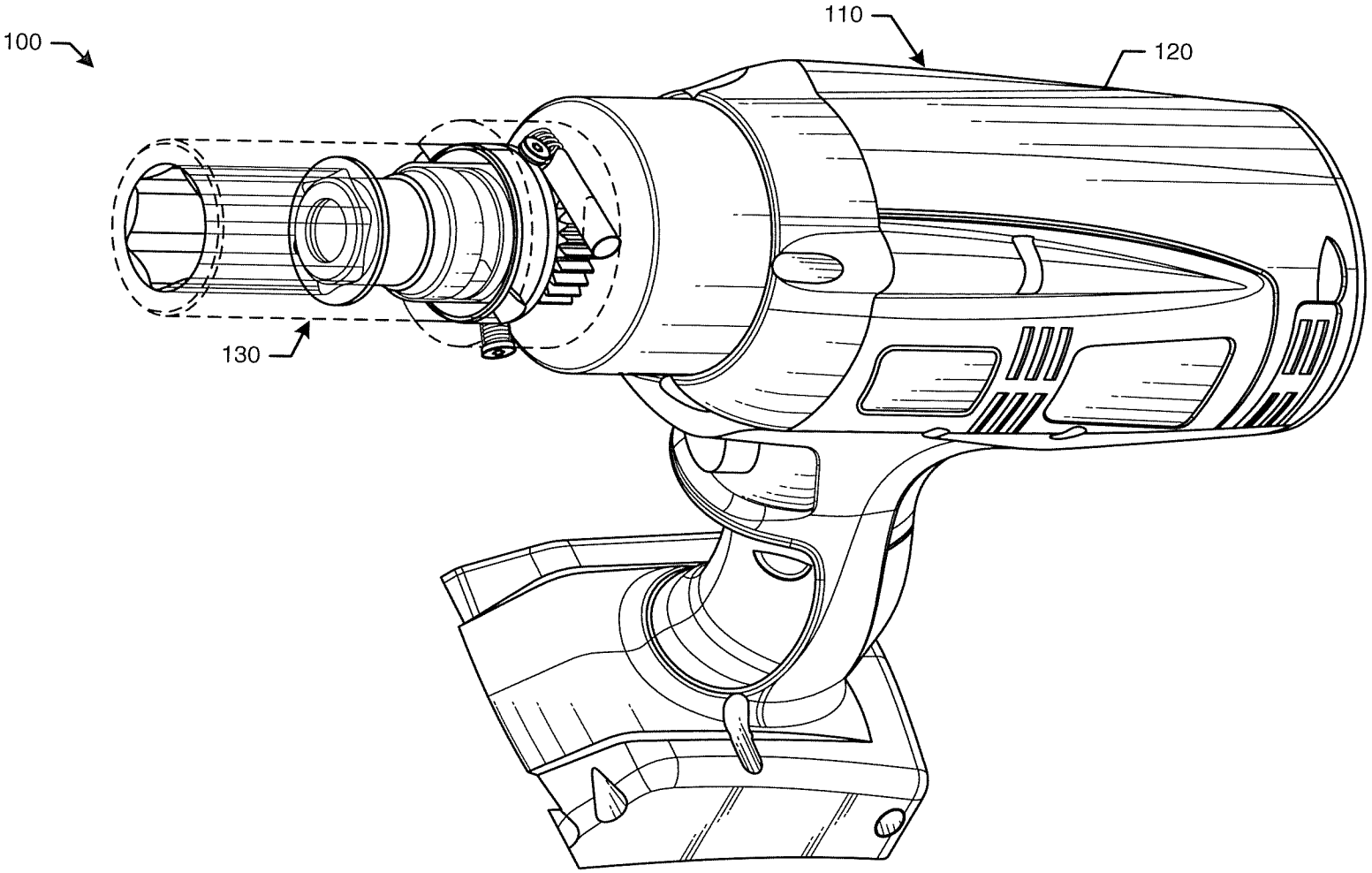
FIG. 4 is a perspective view of a bolt tightening tool as may be described herein.

FIGS. 4-7 show a bolt tightening system 100 as may be described herein. Specifically, FIG. 4 shows a bolt tightening tool 110. The bolt tightening tool 110 may include a drill 120 and a tightening sleeve 130. The drill 120 may be a conventional high torque drill. The drill 120 may be battery powered for use in the field. Other types of power sources may be used herein. The drill 120 may be reversible. Other types of torque application devices may be used herein.

Figure 6:
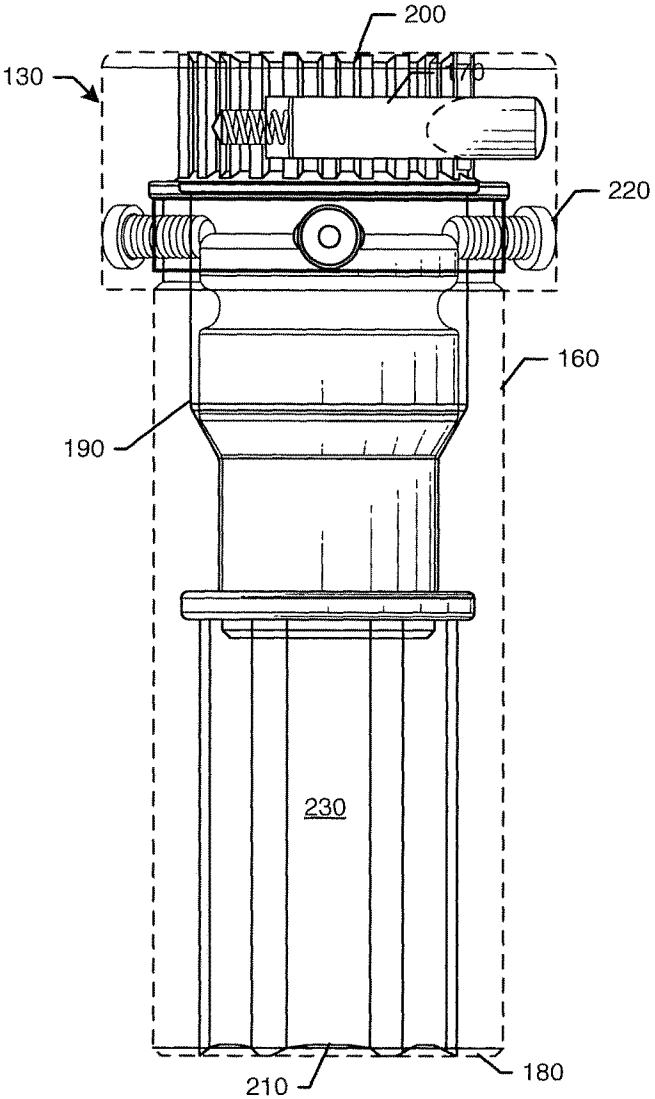
FIG. 6 is a side view of the tightening sleeve of FIG. 5.
Figure 5:
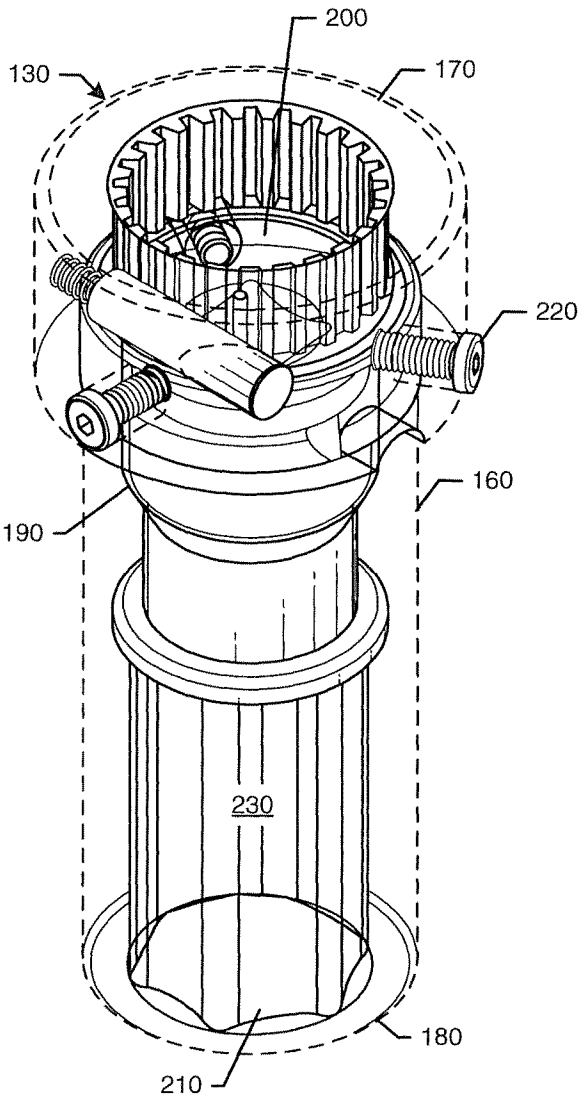
FIG. 5 is a perspective view of a tightening sleeve of the bolt tightening tool of FIG. 4.
Figure 7:
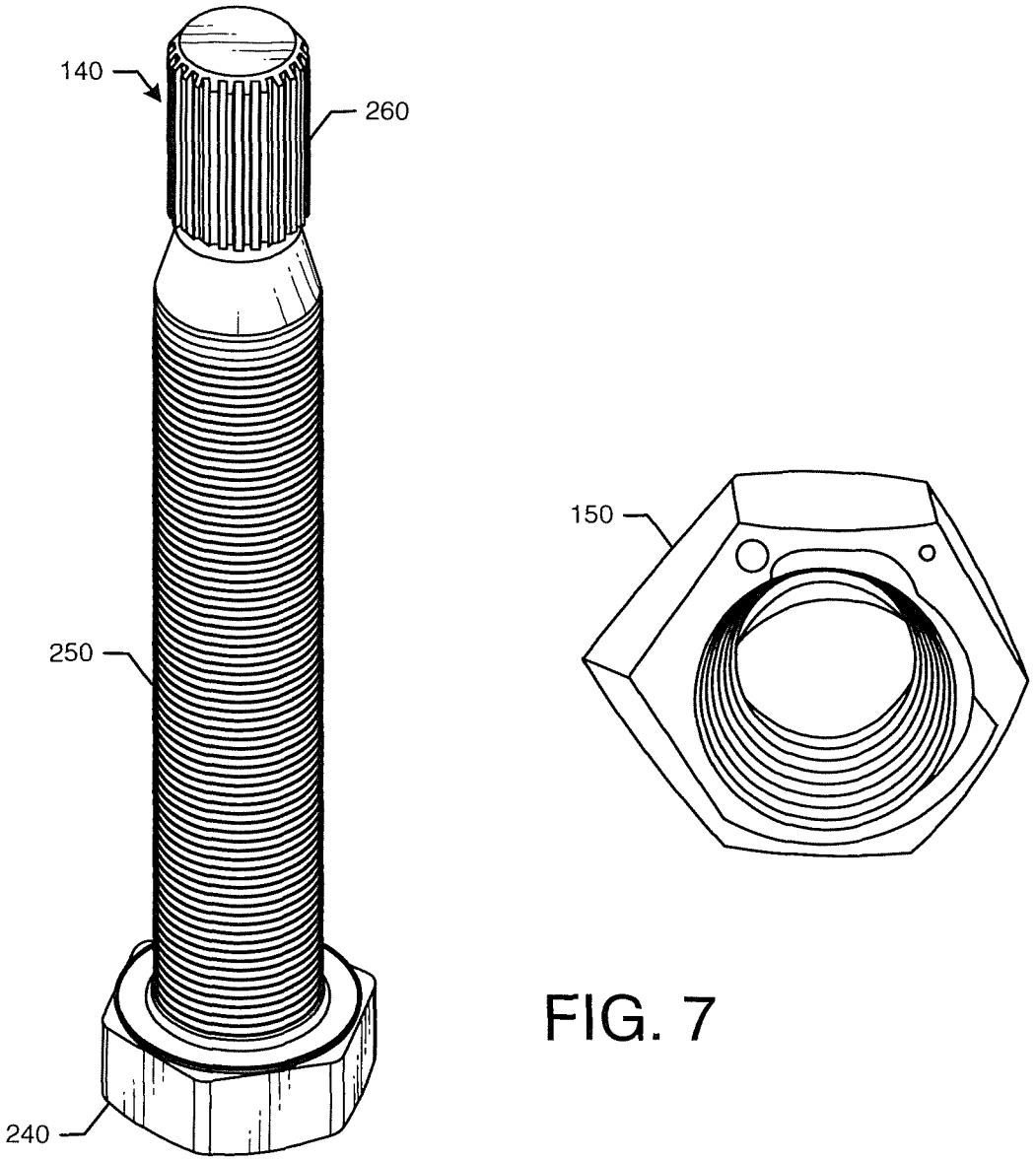
FIG. 7 is a perspective view of a bolt and nut for use with the bolt tightening tool of FIG. 4.

FIGS. 5 and 6 show an example of the tightening sleeve 130. FIG. 7 shows a bolt 140 and a nut 150 for use therewith. The tightening sleeve 130 may include an outer shell 160 with a first end or a drill end 170 and a second end or a nut end 180. The outer shell 160 may have any suitable size, shape, or configuration. The drill end 170 may have a rotatable drill adapter 190 positioned therein. The drill adapter 190 may have a drill aperture 200 on one end sized for the drill head and a spline aperture 210 on the other end sized for the bolt 140 as will be described in more detail below. The drill adapter 190 may be configured to rotate within the outer shell 160 of the sleeve 130 as powered by the drill 120. The outer shell 160 may have a number of set pins 220 to accommodate the size of the drill 120. The nut end 180 of the outer shell 160 may define a hex chamber 230. The hex chamber 230 may be configured to accommodate the nut 150 securely therein. Hex chamber 230 of different configurations may be used with nuts 150 of different configurations. Other configurations and other components may be used herein.

The bolt 140 may extend from a bolt head 240, to a threaded body 250, to a spline end 260. The bolt 140 and the threaded body 250 may have any suitable length and width. The threaded body 250 may be sized to accommodate the nut 150. The spline end 260 may be sized to accommodate the spline aperture 210 of the drill adapter 190 so as to rotate the bolt 140. The nut 150 may be hex shaped and may be a Stover nut, a crimp nut, a top lock nut, and the like with good shock and vibration resistance. Other components and other configurations may be used herein.

In use, the flange 70 may be assembled by aligning the first member 75, the second member 80, and the gasket 85. The bolt tightening system 100 then may be used to tighten the bolts 140 about the flange 70. Specifically, the bolt 140 may be inserted through the bolt aperture 97 through the rear or through the second member 80 of the flange 70 until the bolt head 240 is in contact with the second member 80. The nut 150 may be placed on the threaded body 250 of the bolt 140. The bolt tightening tool 110 may be used to tighten the bolt. 140. The tightening sleeve 130 of the bolt tightening tool 110 may be positioned about the bolt 140 and the nut 150 until the spline end 260 of the bolt 140 is positioned within the spline aperture 210 of the drill adapter 190 and the nut 150 is positioned within the hex chamber 230.

The drill 120 of the bolt tightening tool 110 may be activated so as to rotate the drill adapter 190. Rotation of the drill adapter 190 thus rotates the bolt 140 while the nut 150 remains stationary within the hex chamber 230. The threaded body 250 advances through the nut 150 until the nut 150 is positioned adjacent to the first member 75 of the flange 70 and properly torqued. The bolt tightening tool 110 then may be removed and the process may be repeated for the next bolt 140. The bolt tightening tool 110 also may be used to remove a nut 150 from the bolt 140 by reversing the direction of the drill 120.

The bolt tightening system 100 thus provides fast and efficient installation and removal of bolts 140 and nuts 150 in an automated fashion. The bolt tightening system 100 provides essentially one handed bolt installation. The bolt tightening system 100 is particularly useful in close quarters such as about the endcover 60 of the combustion can 65 but also is applicable to any bolt and nut pair that is compatible with the bolt tightening tool 110. The bolt tightening system 100 thus may save time and money as well as reduce safety issues in the field.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A bolt tightening system, comprising:
a bolt;
a nut; and
a bolt tightening tool;
wherein the bolt tightening tool comprises a tightening sleeve with an adapter and a chamber therein; and
wherein the adapter applies a torque to the bolt and the chamber holds the nut in place.

2. The bolt tightening system of claim 1, wherein the bolt tightening tool comprises a drill in communication with the adapter.

3. The bolt tightening system of claim 2, wherein the adapter comprises a drill aperture to accommodate the drill.

4. The bolt tightening system of claim 1, wherein the tightening sleeve comprises a drill end and a nut end.

5. The bolt tightening system of claim 1, wherein the tightening sleeve comprises an outer shell.

6. The bolt tightening system of claim 1, wherein the tightening sleeve comprises one or more set pins.

7. The bolt tightening system of claim 1, wherein the bolt comprises a threaded body and a spline end.

8. The bolt tightening system of claim 7, wherein the adapter comprises a spline aperture sized to accommodate the spline end of the bolt.

9. The bolt tightening system of claim 7, wherein the nut is sized to accommodate the threaded body of the bolt.

10. The bolt tightening system of claim 1, wherein the chamber comprises a hex shaped chamber.

11. A method of applying a bolt to a flange, comprising:
positioning the bolt through an aperture in the flange;
positioning a nut on a threaded body of the bolt;
positioning a spline end of the bolt in an adapter of a bolt tightening tool;
positioning the nut in a chamber of the bolt tightening tool; and
applying a torque to the bolt by the bolt tightening tool while preventing the nut from rotating within the chamber.

12. A bolt tightening system, comprising:
a bolt with a threaded body and a spline end;
a nut; and
a bolt tightening tool;
wherein the bolt tightening tool comprises a tightening sleeve with an adapter sized to accommodate the spline end on one end and a chamber sized to accommodate the nut on a second end.

13. The bolt tightening system of claim 12, wherein the bolt tightening tool comprises a drill in communication with the adapter.

14. The bolt tightening system of claim 13, wherein the adapter comprises a drill aperture to accommodate the drill.

15. The bolt tightening system of claim 12, wherein the adapter comprises a spline aperture sized to accommodate the spline end of the bolt.

* * * * *